US007923938B2

(12) United States Patent
Sokola

(10) Patent No.: US 7,923,938 B2
(45) Date of Patent: Apr. 12, 2011

(54) SYSTEM AND METHOD FOR PROVIDING INDUCTIVE POWER TO IMPROVE PRODUCT MARKING AND ADVERTISING

(75) Inventor: Ray L. Sokola, Perkasie, PA (US)

(73) Assignee: General Instrument Corporation, Horsham, PA (US)

( * ) Notice: Subject to any disclaimer, the term of this patent is extended or adjusted under 35 U.S.C. 154(b) by 847 days.

(21) Appl. No.: 11/313,462

(22) Filed: Dec. 21, 2005

(65) Prior Publication Data

US 2007/0165366 A1 Jul. 19, 2007

(51) Int. Cl.
*H05B 39/04* (2006.01)

(52) U.S. Cl. ..... 315/209 R; 315/200 R; 315/217; 315/224

(58) Field of Classification Search ..... 315/209 R, 315/70, 72, 74, 212, 254, 276, 291, 352, 315/600, 614, 46, 87
See application file for complete search history.

(56) References Cited

U.S. PATENT DOCUMENTS 4,964,777 A * 10/1990 Kleynjans et al. ..... 414/401
5,600,908 A * 2/1997 Hogberg ..... 40/449
6,247,991 B1 * 6/2001 Chen ..... 446/242
6,466,126 B2 * 10/2002 Collins et al. ..... 340/333
6,798,389 B1 9/2004 Eberhardt
7,119,759 B2 10/2006 Zehner et al.
7,164,255 B2 1/2007 Hui
7,267,000 B1 9/2007 Usui et al.
2006/0020803 A1 * 1/2006 O'Hagan ..... 713/176
2006/0207134 A1 * 9/2006 Harry ..... 40/453
2007/0007221 A1 1/2007 Mann
2007/0064406 A1 3/2007 Beart
2007/0165366 A1 7/2007 Sokola

* cited by examiner

*Primary Examiner* — Douglas W Owens
*Assistant Examiner* — Jianzi Chen
(74) *Attorney, Agent, or Firm* — Stewart M. Wiener

(57) ABSTRACT

A system and method are described in which power is inductively supplied to a product or a package containing a product. This power is received via a coil and used by a light source to further enhance the presentation of the product or packaging. The illuminated light draws more attention to the product or package and thereby increases the probability that a prospective buyer will buy the product. Power is supplied to the package via a coil mounted to a shelf system. The frequency of the power supplied to the shelf coil may be changed to change the frequency at which the light source in the product or package illuminates.

13 Claims, 14 Drawing Sheets

900

SYSTEM AND METHOD FOR PROVIDING INDUCTIVE POWER TO IMPROVE PRODUCT MARKING AND ADVERTISING

RELATED APPLICATION

This application is related to U.S. application Ser. No. 11/313,461 entitled "System and Method for Providing Inductive Power to Improve Product Marking and Advertising" filed on the same day herewith.

Field of the Invention

A system and method are described that provide power to a product package and/or the product itself through inductive coupling. This power is then used to light-up a portion of the package or product or a screen mounted into the package and draw the attention of prospective buyers.

BACKGROUND OF THE INVENTION

Advertisers and marketers are always searching for ways to get prospective buyers to buy their products. Tremendous amounts of money and ingenuity go into developing product advertisements and colorful product packaging. All to hopefully increase sales.

One method that may be used is to provide a light source on a product or product package. Such a light would distinguish that particular product from competitor's products. One problem with this form of packaging is providing power to turn the light on.

In one proposed system a battery is installed in the packaging to provide the necessary power for the light. However, there are several drawbacks to this approach.

First, the battery adds some significant costs to the packaging itself. In low margin products, this added cost may be unacceptable. Second, batteries have a limited lifetime. If a product remains in transit to the store and then on the shelf for many months, it is possible the power from the battery would be drained before a potential buyer would ever see it. Third, the light is not really needed once the prospective buyer has purchased the product. There is therefore no need to grab the user's attention with a light once the user has purchased the product and taken it home. What is needed is a form of powering a light on the product or packaging that can overcome these shortfalls.

BRIEF DESCRIPTION OF THE DRAWINGS

Like numbers in different figures denote similar elements among the figures.

DETAILED DESCRIPTION

Figure 1:
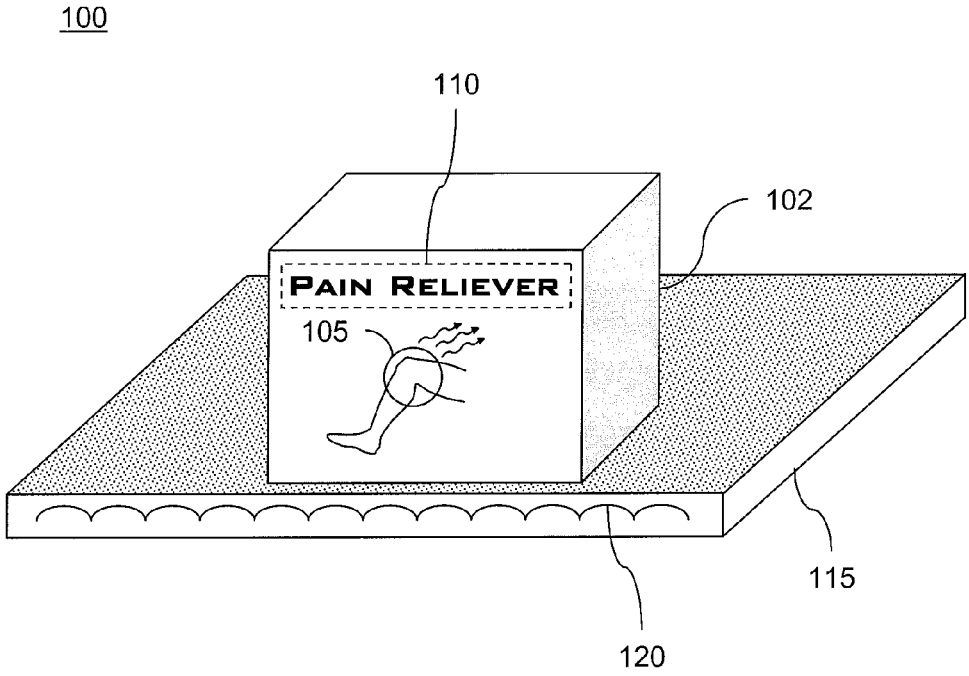
FIG. 1 shows an illustrative package that includes a light element.

FIG. 1 shows a package 100. A package is something that encapsulates or surrounds, partially or wholly, a particular product. The package usually protects the product during shipping to and display at a store and it may provide a medium for product identification, advertising and marketing. Package 100 includes a housing 102 typically made of paperboard or plastic and may be shaped in any of a variety of structures such as a bottle or a box. Inside housing 102 is a food product, drug or other item (not shown). Package 100 typically also includes writing 110 that identifies the trade name of the consumable item or product, the manufacturer's name, uses for the product, directions for consuming or using the product, chemical or physical composition of the product and potential warnings. Package 100 also includes a display element, such as light source 105, mounted onto housing 102.

Package 100 rests on shelf 115. Shelf 115, in addition to supporting package 100 off of the floor in a horizontal manner, provides power to package 100 to turn on light source 105. Power is provided to package 100 via coil 120 inside shelf 115.

Figure 2:
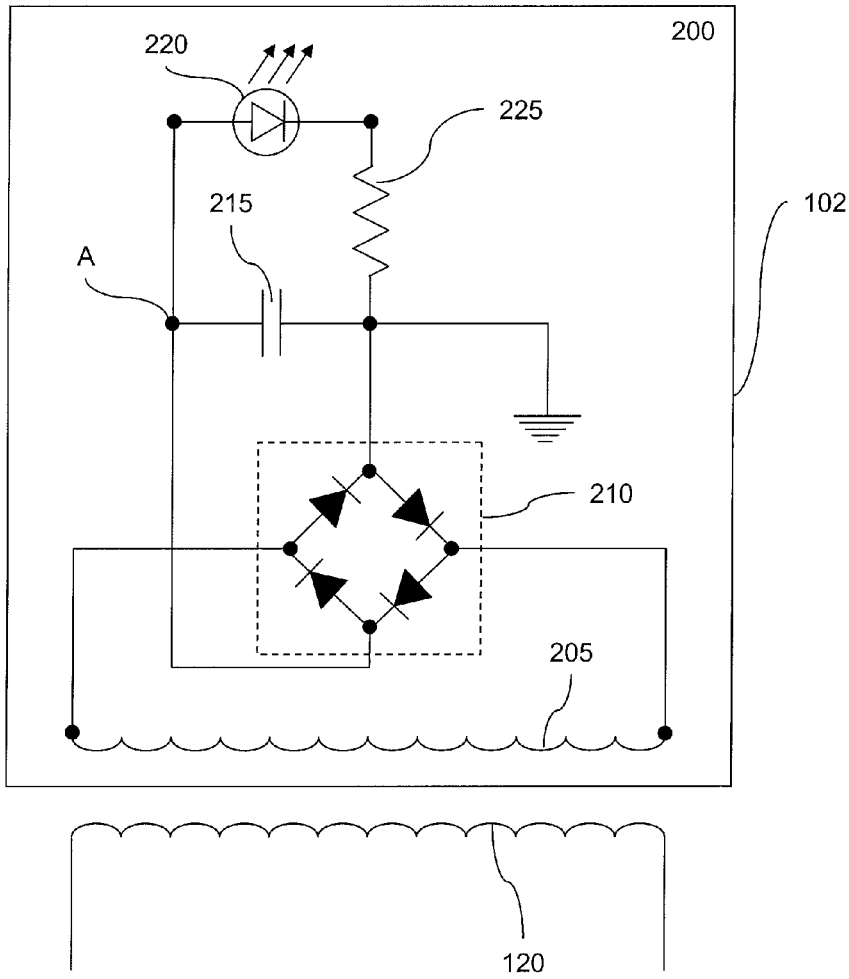
FIG. 2 shows an illustrative circuit used to provide power to a light element on a package.

FIG. 2 shows an illustrative circuit 200 that is used to drive a light source. Circuit 200 resides on a surface of housing 102. Typically circuit 200 is coupled to housing 102 on an inside surface. Circuit 200 includes coil 205. Coil 205 is inductively coupled to coil 120 in a shelf. Coil 205 supplies power to full bridge rectifier 210. The output of fill bridge rectifier 210 is coupled to capacitor 215. Coupled in parallel to capacitor 215 is light-emitting diode (LED) 220 and resistor 225. In this circuit, LED 220 is light source 105 from FIG. 1.

Circuit 200 operates as follows. Coil 120 receives an alternating source of electricity. In one implementation coil 120 receives a sine wave operating at 60 Hz. Coil 205 captures power from coil 120 due to their mutual inductance. Coil 205 then supplies power to the remaining portions of circuit 200.

The power generated by coil 205 will have the same frequency as the frequency of the power supplied to coil 120. If the power to coil 120 has both positive and negative polarities, coil 205 will produce power with both positive and negative polarities.

Full bridge rectifier 210 converts the negative polarity portions of the power generated by coil 205 into positive polarity power. Capacitor 215 acts as a storage device and stores the positive polarity power it receives from full bridge rectifier 210. The result, in an ideal system, is the voltage at node A remains at a DC, positive value. The voltage at node A is used to drive LED 220 and resistor 225. It should be noted that LED 220 and resistor 225 dissipate power from node A so that the voltage at node A will have a ripple. The size of this ripple can be quite small depending on the characteristics of capacitor 215, LED 220, resistor 225 and frequency of the power supplied by coil 205

In one implementation of circuit 200, LED 220 remains on as long as coil 205 is sufficiently coupled to coil 120. In other words, the voltage at node A does not drop to a point at which LED 220 turns off. Instead the voltage at node A ripples between two values that are both sufficient to drive current through LED 220 and resistor 225 and keep LED 220 continuously on.

Figure 3:
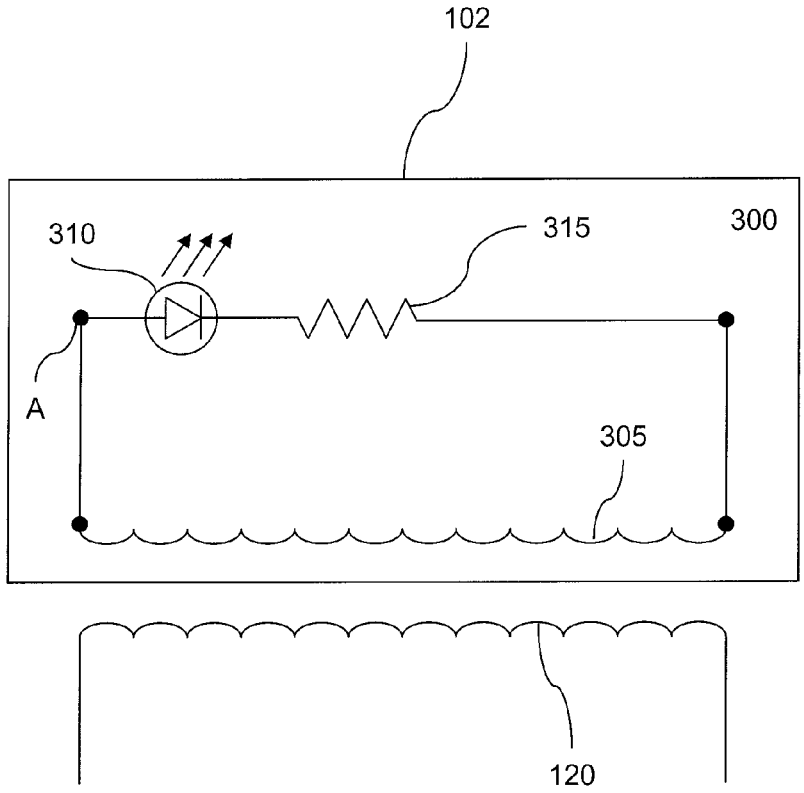
FIG. 3 shows another illustrative circuit used to provide power to a light element on a package.

FIG. 3 shows an illustrative circuit 300 used to power a light source. Circuit 300 is coupled to a surface, such as an inside surface, of housing 102. Circuit 300 includes a coil 305 that is coupled to LED 310 and resistor 315.

Coil 305 is inductively coupled to coil 120 in shelf 115. Like the circuit of FIG. 2, coil 305 receives power from coil 120 due to their mutual inductance. Coil 305 therefore outputs a signal having the same frequency as applied to coil 120.

When coil 305 supplies a sufficient positive voltage across nodes A and B, LED 310 turns on and conducts current to resistor 315. When LED 310 is on, it emits light. However, when the voltage across nodes A and B is a small positive voltage or a negative voltage, LED 310 does not turn on and does not emit any light nor does it conduct current to resistor 315. Thus, LED 310 turns on and off at the same frequency as the voltage oscillating in both coils 120 and 305. As an example, if the voltage across coil 120 oscillates at 60 Hz, the voltage generated by coil 305 will also oscillate at 60 Hz. LED 310 will therefore turn on and off 60 times a second. The human eye cannot detect a flashing light at this frequency so it appears to the prospective buyers as a constant source of light.

Figure 4:
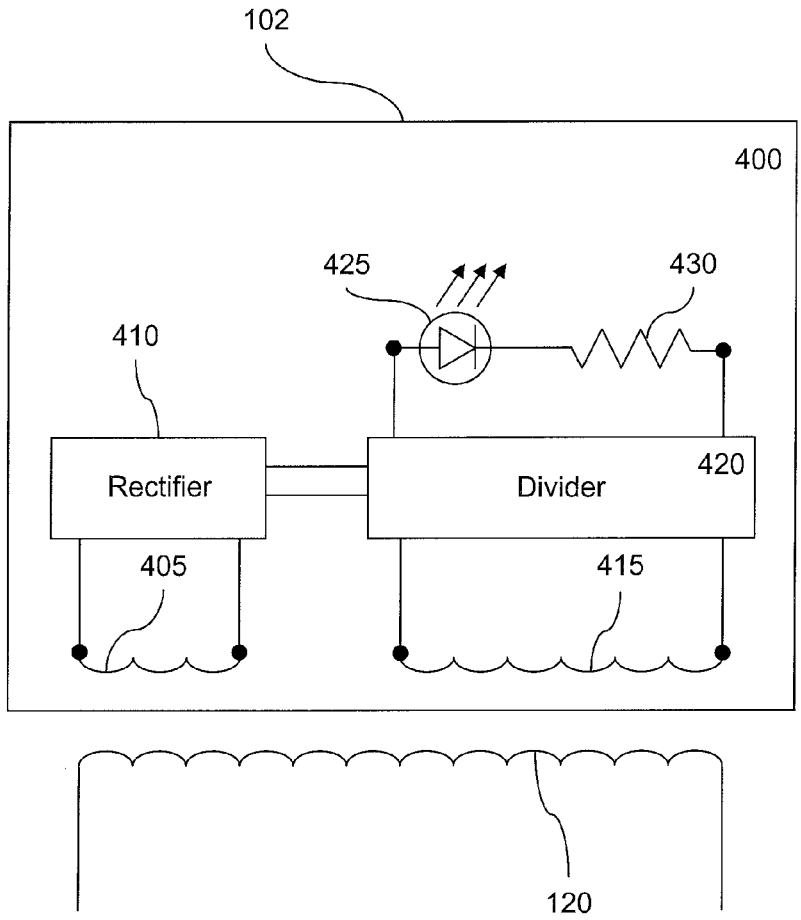
FIG. 4 shows another illustrative circuit used to provide power to a light element on a package.

FIG. 4 shows another illustrative circuit 400 used to power a light source. Circuit 400 is coupled to a surface, such as an inside surface, of housing 102. Circuit 400 includes coil 405 that is inductively coupled to coil 120 in shelf 115 (not shown). Coil 405 provides power to rectifier 410. Rectifier 410 may be a full bridge rectifier, a half bridge rectifier or a single diode.

Circuit 400 also includes another coil 415. Like coil 405, coil 415 is inductively coupled to coil 120. Coil 415 is also coupled to a frequency divider 420. It should be noted that any frequency divider known to those of ordinary skill in the art may be used in circuit 400. The output of frequency divider 420 is coupled to LED 425 and resistor 430.

Circuit 400 operates as follows. Coil 405 generates power in response to the oscillating power provided through coil 120. Typically the power generated by coil 405 includes both positive and negative polarity components. Rectifier 410 receives this oscillating power from coil 405 and produces a positive, relatively stable DC power output. An example of a rectifier circuit includes the full bridge rectifier 210 and capacitor 215 shown in FIG. 2. The DC power generated by rectifier 410 is provided to divider 420.

Divider 420 also receives an oscillating signal from coil 415. Divider 420 divides the frequency of that signal and outputs it to LED 425 and resistor 430. Divider 420 provides a different frequency signal to LED 425 and resistor 430 than that provided to coil 120 and generated by coils 405 and 415. As an example, if coil 120 receives power at 60 Hz, and frequency divider 420 divides by 60, LED 425 will turn on once a second. The human eye can perceive an LED turning on and off once a second. If circuit 400 is implemented in package 100 as such, prospective buyers will observe light source 105 turning on and off once a second.

Figure 5:
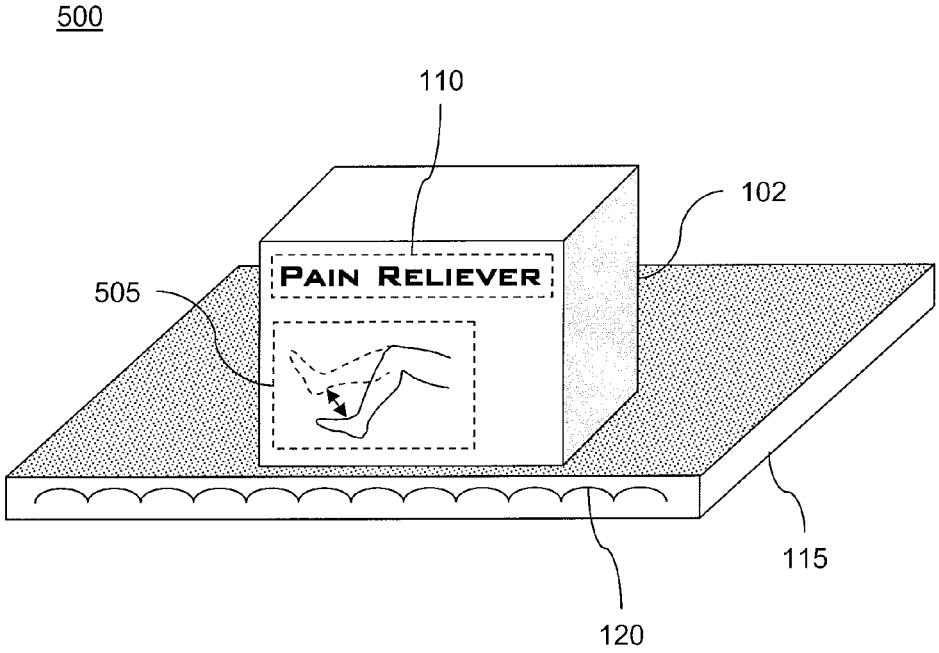
FIG. 5 shows another illustrative package that includes a screen.

FIG. 5 shows another illustrative package 500 that includes a screen. Like the package 100 shown in FIG. 1, package 500 includes a housing 102. Package 500 also includes writing 110 that identifies the trade name of the consumable item or product, the manufacturer name, uses for the product, directions for using or consuming the product and potential warnings. Unlike package 100, the display element coupled to package 500 is a screen 505 mounted onto housing 102 instead of a light source.

Screen 505 may be any size screen with any resolution. An example of screen 505 is an LCD screen with a 1 inch diameter. Screen 505 allows for a more dynamic display in that the image displayed on screen 505 can vary over time. For example, a leg can be shown flexing back and forth at the knee with an indication that there is pain in the knee. Screen 505 can also display other images such as text describing special offers or pricing.

Figure 6:
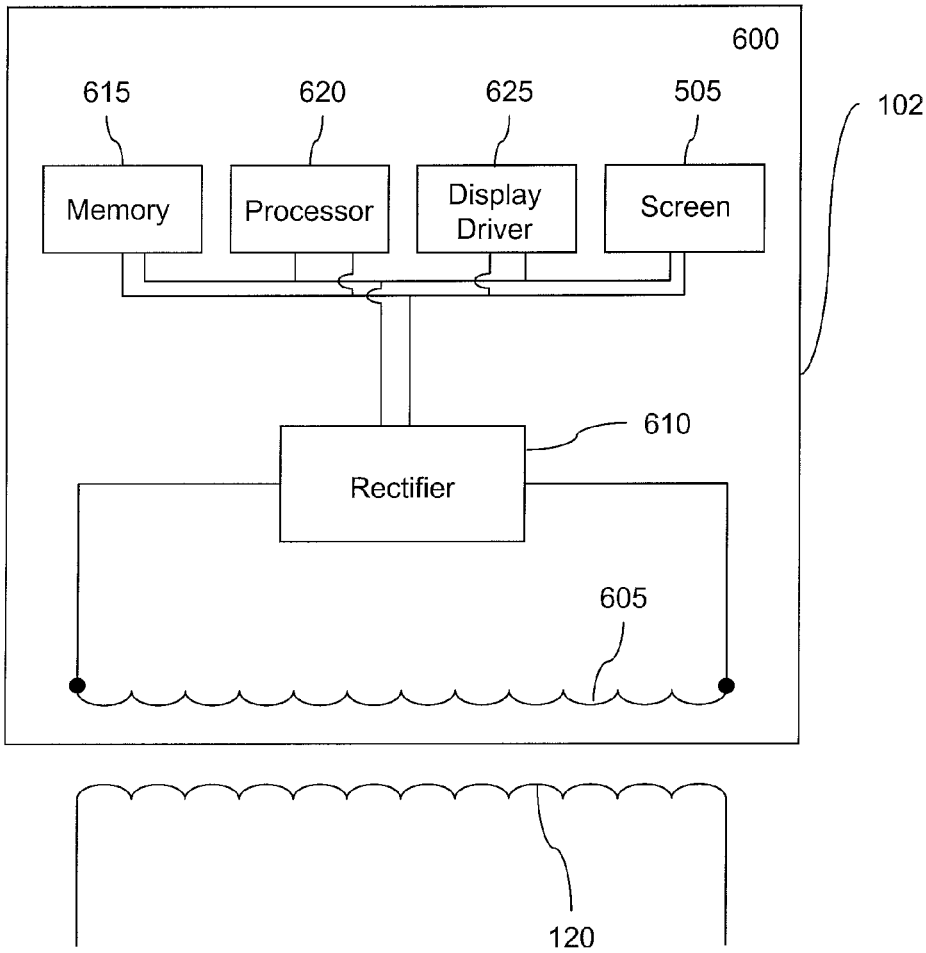
FIG. 6 shows an illustrative circuit for powering and driving a screen.

FIG. 6 shows a circuit 600 for powering and driving a screen. Circuit 600 is coupled to a surface, such as an inside surface, of housing 102. Circuit 600 includes coil 605 that is inductively coupled to coil 120 in shelf 115 (not shown). Coil 605 provides power to rectifier 610. Rectifier 610 may be a full bridge rectifier or other suitable circuit. Rectifier 610 in turn provides power to memory 615, processor 620, display driver 625 and screen 505.

Circuit 600 operates by receiving power from coil 120 via the mutual inductance between coils 120 and 605. Typically the output power from coil 605 will be alternating between positive and negative polarities. Rectifier 610 converts the negative polarity portions of the power it receives into positive polarity power and provides a substantially stable DC power output to memory 615, processor 620, display driver 625 and screen 505.

Memory 615 stores pixel data. In one illustrative system the pixel data is stored into memory 615 before or at the time circuit 600 is mounted onto package 102. Processor 620 retrieves that pixel data from memory 620. In some implementations processor 620 may process the data received from memory 615. That process may include a decoding and/or a decryption process. Processor 620 outputs data to display driver 625. Display driver 625 formats the data it receives from processor 620 so it can be properly displayed by screen 505 and outputs the formatted data to screen 505. Screen 505 generates visual images based upon the data it receives from display driver 625.

Processor 620 controls the rate at which pixel data is retrieved from memory 615 which in turn relates to how often the image displayed on screen 505 changes. In some cases the image displayed is constant, from the perspective of the viewer, while in other cases the image changes (e.g. a leg bending back and forth at the knee).

The rate at which the images change may be dependent or independent of the frequency and amplitude of the signal generated by coil 605. In an implementation where the images displayed on screen 505 vary dependent in frequency based upon the frequency or amplitude of the signal generated by coil 605, processor 620 detects those changes and retrieves pixel data from memory 615 accordingly. This allows the operator of the shelf containing coil 120 to change the amplitude or frequency of the current passing through coil 120 and cause screen 505 to display a different image.

It should also be noted that while memory 615, processor 620 and display driver 625 are shown as separate elements in circuit 600, one of ordinary skill in the art could combine some or all of them into one circuit as an ASIC or programmed into a programmable circuit. Processor 620 may also be omitted if display driver 625 has the capability to retrieve pixel data 615 on its own and lesser control of the image being displayed on screen 505 is desired.

Figure 7:
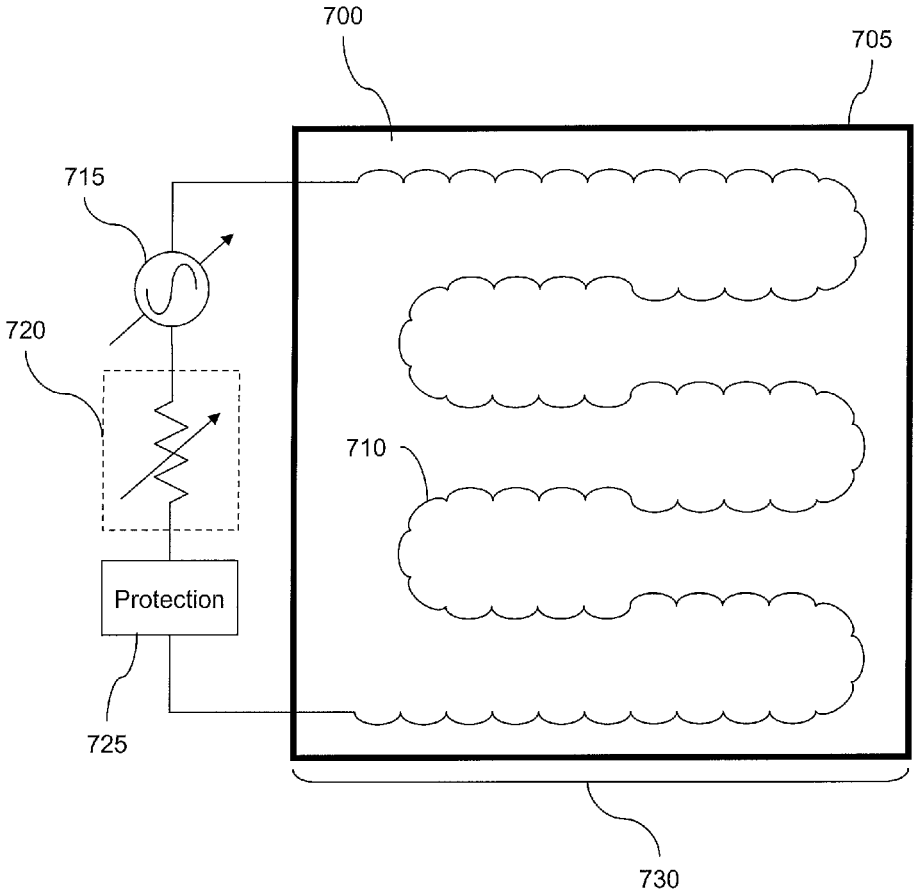
FIG. 7 shows an illustrative shelf used to provide power to a product or package.

FIG. 7 shows a cross-sectional view of an illustrative shelf 700. Shelf 700 includes a housing 705. Housing 705 will typically be made of an insulative material such as plastic.

Housing 705 may also contain a shield of conductive material to prevent the flux lines from emanating in directions other than up into packages 100. In addition, housing 705 may not be a completely closed object with a hollow interior.

Coil 710 is placed inside housing 705 and is coupled to an AC power source 715. In one implementation, AC power source 715 is variable in frequency. Coil 710 wraps back in forth in housing 705 in a serpentine fashion. By wrapping coil 710 in this manner, all of the packages placed on top of shelf 700 will be in close proximity to a portion of coil 710. In this way, as packages are removed from the front edge 730 of shelf 700, the additional packages behind those will receive power and have powered light sources 105.

Coupled in series with AC power source 715 is a resistor 720. Resistor 720 is used to limit the amount of current drawn by coil 710. In one implementation, resistor 720 is variable. In this way the user can adjust the resistance of resistor 720 to increase or decrease the amount of current flowing through coil 710. By allowing for adjustable current flow, the user can control how much power is dissipated to the packages resting on shelf 700 while keeping the amount of current flowing through coil 710 at a safe amount.

For added safety, protection circuit 725 may also be added in series to the AC power source 715 and coil 710. Protection circuit 725 will create an open circuit or high impedance condition to prevent excess current from flowing through coil 710. Examples of protection circuit 725 include fuses, circuit breakers, thermistors or thermal switches.

Operation of shelf 700 in conjunction with package 100 is as follows. A store clerk places packages 100 on shelf 700. The coils inside packages 100 are then in close proximity to coil 710 so as to be coupled via mutual induction. The clerk then adjusts the frequency and amount of the power supplied to coil 710 by turning a knob on AC power source 715 and a knob on resistor 720. As power oscillates through coil 710, power is generated by the coil in package 100 as described previously in conjunction with FIGS. 2-6 so that the light source 105 is illuminated or screen 505 displays images. When a prospective purchaser picks the package 100 off of shelf 700, the mutual inductance between package 100 and shelf 700 is broken, due to the increased distance between the coils, and the light source 105 stops illuminating or screen 505 turns off.

As noted earlier, light sources 105 in circuits 200 and 300 illuminate at the same frequency as the frequency of the power supplied to coil 120 in some cases. In many typical implementations, the frequency of power supplied to coil 120 will be so high that the human eye may not perceive LED 220 or 310 flashing. By using a variable AC power source 515, circuits 200 and 300 can receive power at different frequencies and in turn turn LED 220 or 310 on and off at a frequency perceptible to the human eye.

Similarly, variable AC power supply 515 could be used with circuit 400 of FIG. 4 and allow for greater flexibility in setting the frequency at which LED 425 turns on and off. As an example, if divider 420 divides by 60 and the frequency of the power generated by coil 415 is 30 Hz, LED 425 will turn on and off once every 2 seconds. Similarly if AC power source 515 provides power to coil 510 at 120 Hz, and divider 420 divides by 60, LED 425 will turn on and off twice every second.

Figure 8:
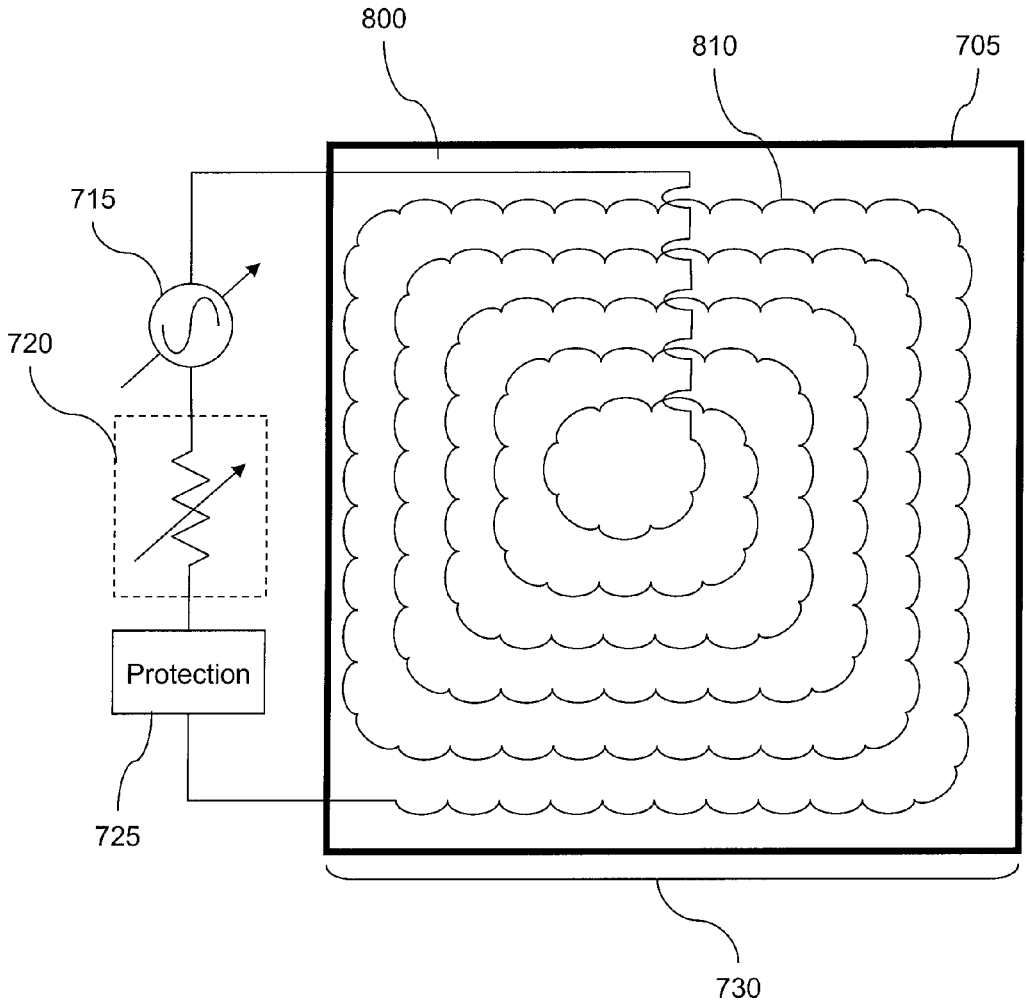
FIG. 8 shows another illustrative shelf used to provide power to a product or package.

FIG. 8 shows another shelf 800. Shelf 800 contains many of the same elements as shelf 700 that are similarly numbered. One difference between shelf 700 and shelf 800 is the manner in which coil 810 is wrapped inside housing 705. In shelf 800, coil 810 is wrapped in a spiral fashion inside housing 705. Again, coil 810 provides power through inductive coupling to all packages 100 placed on shelf 800.

It should be noted that shelves 700 and 800 provide power to all packages or products resting upon them. Thus, light sources 105 will be illuminated and screens 505 will be operational even on packages or products that are not visible to prospective buyers. This is because some will be blocked from view by other packages 100 being placed in front of them. A lot of power is therefore wasted.

Figure 9:
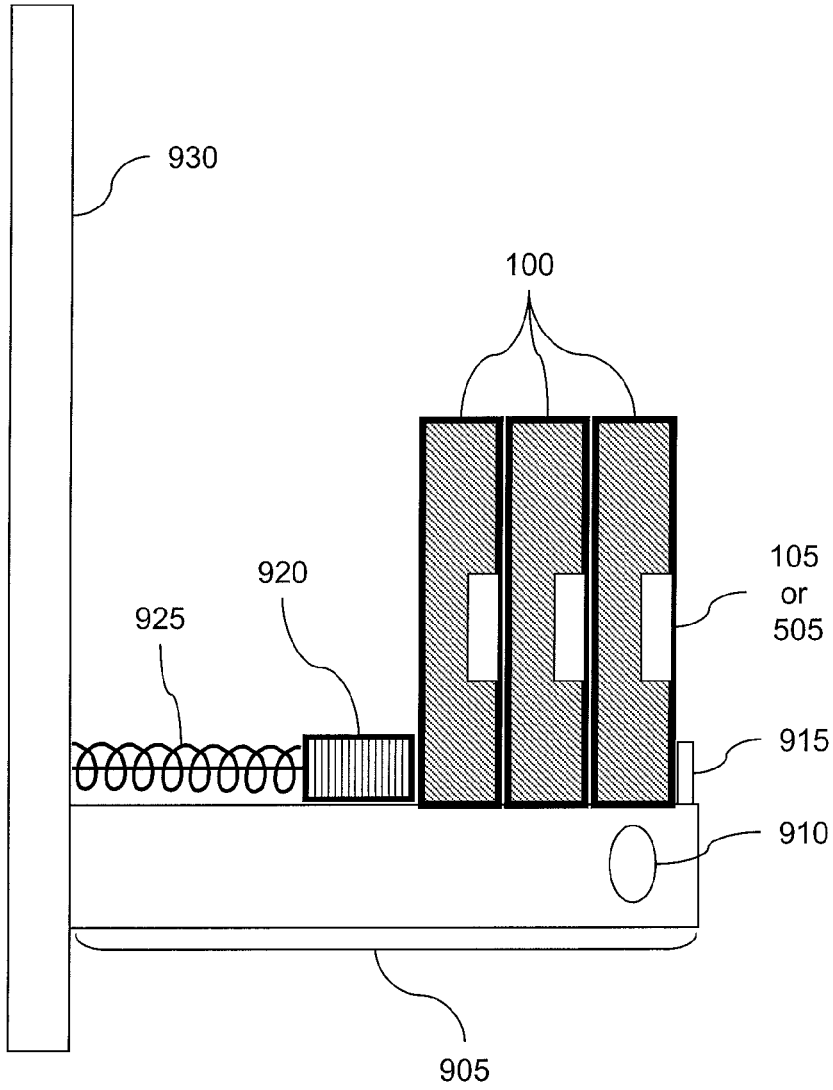
FIG. 9 shows another illustrative shelf system used to provide power to a product or package.

Shelf system 900 shown in FIG. 9 solves this problem. Shelf system 900 includes housing 905. Inside housing 905 is a coil 910 located near the front edge. Placed on top of housing 905 are packages 100 or products that include a light source 105 or a screen 505.

Housing 905 also includes a lip or stop 915 at the front edge of housing 905. Lip or stop 915 may be an integrated part of housing 905 or it may be a separate piece attached to housing 905. Behind packages 100 is ram 920. Ram 920 is coupled to spring 925 that is in turn coupled to surface 930.

Shelf system 900 operates as follows. A clerk pushes ram 920 towards surface 930 and thereby compresses spring 925. The clerk then inserts packages 100 between ram 920 and lip or stop 915. The clerk releases ram 920 and it pushes against packages 100 because of the force exerted by spring 925. Packages 100 are in turned pushed up against lip or stop 915.

In this arrangement only the first one, two or three or so packages 100 are near enough to coil 910 so as to be coupled to coil 910 via mutual inductance. The actual number of packages 100 coupled to coil 910 will depend on the size of coil 910, the size of packages 100, the size of the coils inside packages 100 and the amount of current flowing through coil 910, among other things. Of the plurality of packages resting on housing 905 between lip or stop 915 and surface 930, only one or a few near the front edge and coil 910 will receive enough power to have their respective light source 105 illuminated or screens 505 operative.

When a prospective buyer decides to purchase a package 100, he/she selects the first or second one pressed up against lip or stop 915. Ram 920 will then be pushed toward lip or stop 915 by spring 925 which in turn causes the remaining packages 100 to move towards lip or stop 915. Ram 920 and packages 100 stop moving when the next package 100 is resting against lip or stop 915. In this way a new subset of packages is close enough to coil 910 to receive power and have their respective light sources 105 illuminated.

Figure 10:
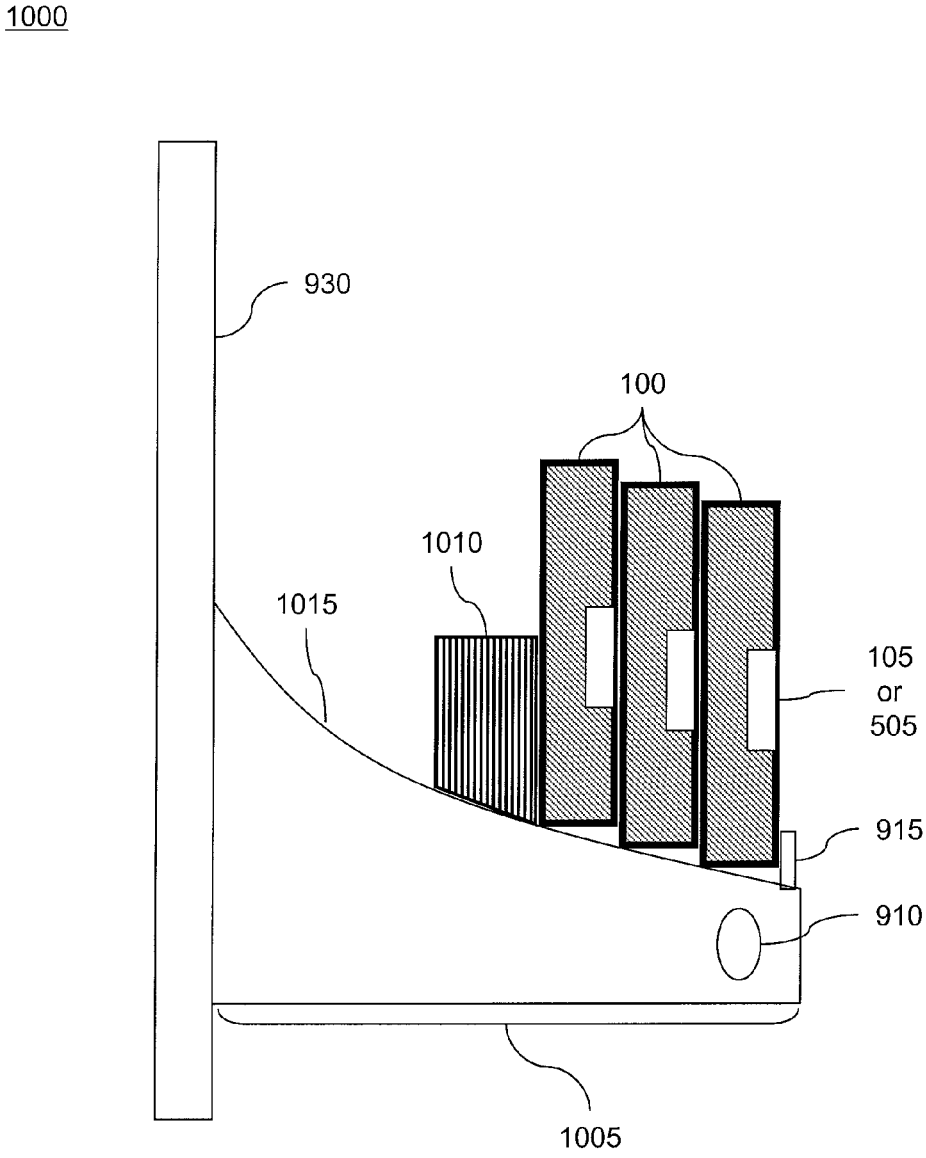
FIG. 10 shows another illustrative shelf system used to provide power to a product or package.

FIG. 10 shows an alternative shelf system 1000. Shelf system 1000 includes a housing 1005 that includes coil 910 near its front edge. Housing 1005 also includes a lip or stop 915. Housing 1005 is also mounted onto a surface 930, such as a wall. Resting on the top surface 1015 of housing 1005 are packages 100 or products and weight 1010. Top surface 1015 is curved as shown in FIG. 8.

Operation of shelf system 1000 is as follows. Weight 1010 pushes against packages 100 due to the curve of top surface 1015 and gravity. Packages 100 in turn push against lip or stop 915. Like shelf system 900, only one or a few of the packages 100 are close enough to the front edge and coil 910 to be inductively coupled to coil 910. Therefore only one or a few of the packages 100 receive sufficient power from coil 910 to illuminate light sources 105 or operate screen 505.

When a prospective buyer selects package 100 next to or near lip or stop 915, weight 1010 slides down the curved top surface 1015 and pushes the remaining packages 100 against lip or stop 915. In this way a new subset of packages is close enough to coil 910 to receive power and have their respective light sources 105 illuminated or screens 505 operational. Meanwhile, the package 100 selected by the prospective buyer is moved far enough away from coil 910 so as to render any mutual inductance insignificant and thereby stop supplying power to package 100 and stop illuminating light source 105 or operating screen 505. In an alternative system, weight 1010 is not needed if the weight of packages 100 is sufficient to overcome the friction between top surface 1015 and packages 100 so that packages 100 can slide down top surface 1015 and rest on lip or stop 915 by themselves.

Figure 11:
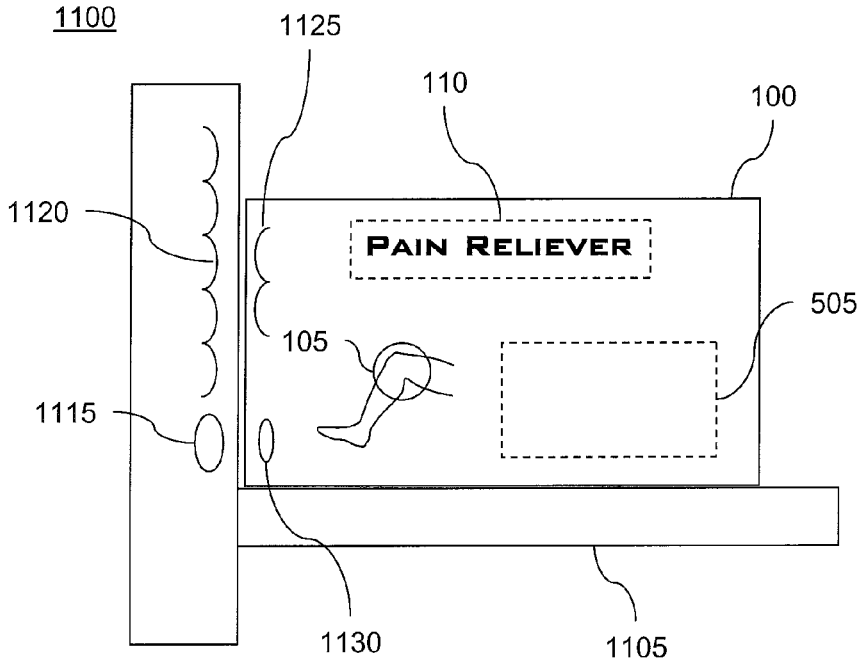
FIG. 11 shows another illustrative shelf system used to provide power to a product or package.

FIG. 11 shows yet another shelf system 1100. Shelf system 1100 includes a shelf 1105 that holds package 100 or products off of the ground. Mounted onto or adjacent to shelf 1105 is a divider 1110. Divider 1110 can be used to separate different products or similar products from different manufacturers on shelf 1105. In a typical application divider 1110 is substantially vertical.

Inside divider 1110 is one or more coils 1115 and 1120. Coil 1115 is oriented into the page while coil 1120 is oriented along the height of divider 1110. Using divider 1110 allows manufacturers of package 100 to place the internal coil 205, 305, 405, 415 or 605 along any of the sides or surfaces of package 100. As shown in FIG. 11, package 100 may have an internal coil 1125 located along a left-side of the package oriented along the height of package 100. Alternatively, package 100 may have an internal coil 1130 located at the bottom-left corner of package 100 oriented along the depth of package 100. Coil 1120 is best oriented to supply power to coil 1125 while coil 1115 is best oriented to supply power to coil 1130. Shelf system 1100 allows the package manufacturer to place coils inside package 100 on other surfaces besides the bottom surface that rests on shelf 1105.

Figure 12:
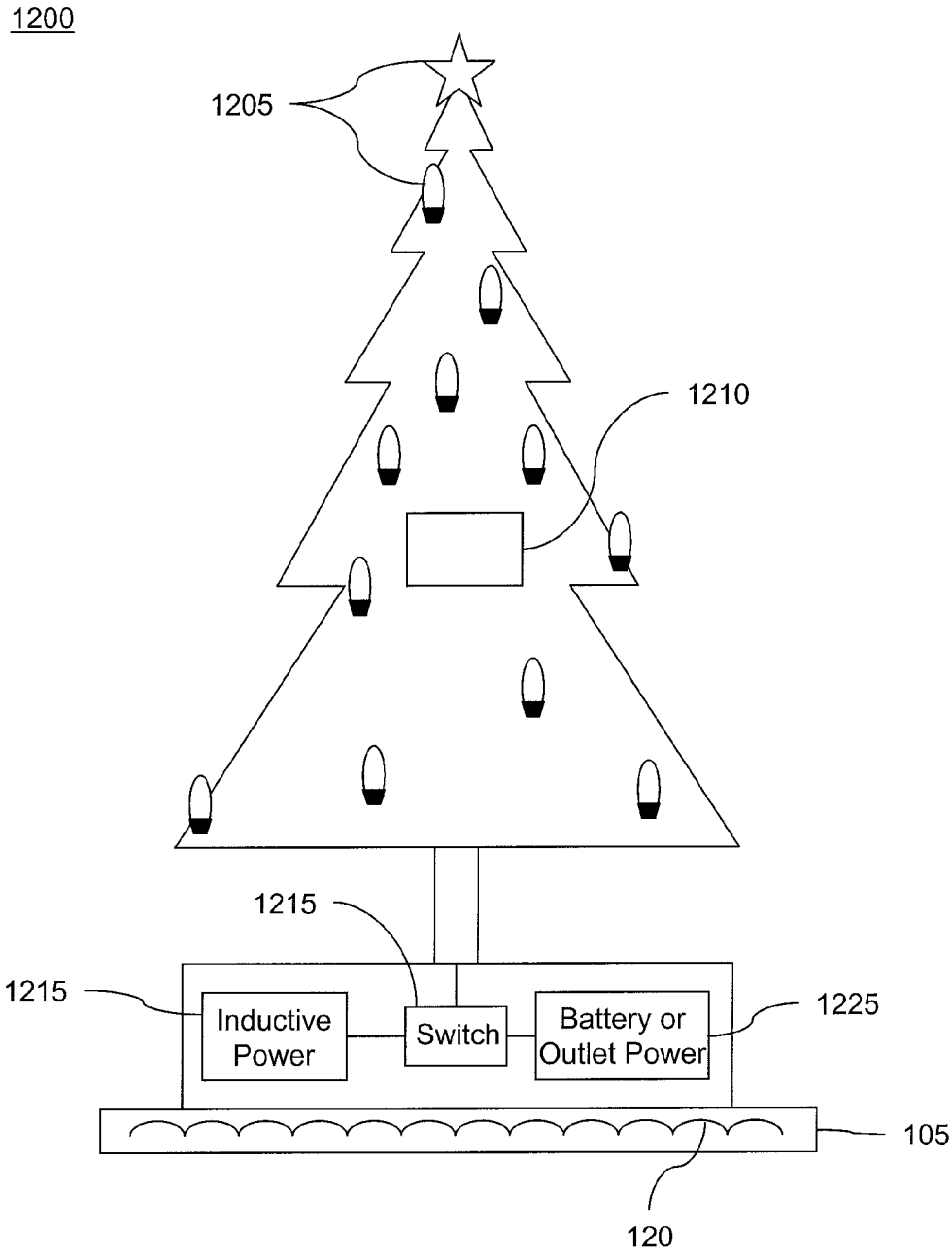
FIG. 12 shows an illustrative product that includes a light element and/or a screen.

FIG. 12 shows a product 1200 that includes light elements and/or a screen. Product 1200 is distinguishable from package 100 in that it is the item desired by the buyer or end user as opposed to a structure that is used to convey the desired product to the buyer or end user. In the example shown in FIG. 12, the product is a small Christmas tree that can be placed on a person's shelf for decoration. Of course other products such as picture frames, Halloween decorations, Hanukkah decorations or other item may incorporate the systems described above.

Product 1200 includes one or more light elements 1205. In some implementations product 1200 includes a screen 1210 in addition to or instead of light elements 1205. Product 1200 rests on shelf 105. As shown in FIG. 12, shelf 105 includes a coil 120. Inside product 1200 is an inductive power source 1215, a switch 1220 and a battery or outlet power source 1225.

Operation of product 1200 is as follows. Product 1200 is placed on shelf 105. Shelf 105 may be in a store or at the end user's home or office. In a typical store setting, shelf 105 will include coil 120. Inductive power source 1215 includes any of the circuits shown in FIGS. 2, 3, 4 or 6 or their equivalents and generates power from the mutual inductance between itself and coil 120 as previously described. Switch 1220 couples inductive power source 1215 to light elements 1205 and/or screen 1210. In this way, product 1200 operates in the store so that the prospective buyer can determine if it is something he/she feels is appropriate for his/her home. If the prospective buyer selects product 1200 off of shelf 105, the mutual inductance between coil 120 and inductive power source 1215 decreases so that light elements 1205 and/or screen 1210 cease to operate.

Once the prospective buyer takes product 1200 home, the prospective buyer switches switch 1220 and either inserts a battery or plugs product 1200 into an electrical outlet. The battery or connection to the electrical outlet provides power to battery/outlet power source 1225 that is then coupled to light elements 1205 or screen 1210 via switch 1220. Of course if the prospective buyer has a shelf like shelf 105 with a coil inside of it, the prospective buyer may use inductive power source 1215 to supply power to light elements 1205 and/or screen 1210 at his or her home or office. Details of the circuitry within second power source 1225 are well-known and can be found in many household items such as in a clock, electric razor or other appliance.

While the above systems and methods have been described using specific elements, it is possible to use alternative elements without departing from the scope of the invention. For example, instead of using LEDs in circuits 200, 300 and 400, an incandescent light bulb or other light source could be used. In addition, rectifier circuits other than full bridge rectifier 210 may be used in circuits 200 and 400. In addition, coil 415 and divider 420 may be replaced with an oscillator or timing circuit that receives power from rectifier 410. In yet other alternative systems, curved surface 1015 could be replaced with a triangular top surface. Finally, it is understood that any arrangement of coils may be used in the packaging, product or shelf. For example, a shelf may have a coil inside of it that extends beyond the front edge as shown in FIGS. 9 and 10 but does not extend throughout the entire shelf as shown in FIGS. 7 and 8 (e.g., it may extend through only have of the shelf's depth).

In addition, other combinations of the described systems may also be employed. For example, spring 925 could be mounted to the front edge of housing 905 and to ram 920 through the top surface of housing 905. In this arrangement, spring 925 is pulled, not pushed, to make room for stocking packages 100 onto housing 905. In this alternative arrangement, spring 925 pulls ram towards lip or stop 915 when one package 100 is removed.

In addition, a shelf system could be developed that uses combinations of spring 925 and ram 920 along with a curved top surface 1015. Finally, multiple coils may be employed both inside package 100 or product 1200 and in shelf systems 900, 1000 and 1100. This would allow for multiple light sources 105, screens 505 or combinations of the two to be mounted onto package 100. The multiple coils in shelf systems 900, 1000 and 1100 may be located in the shelf housings or in the dividers. These multiple coils may also receive power at different frequencies that in turn allow the plurality of lights mounted onto package 100 to illuminate at different frequencies. This can be extended to include using different color light sources 105 to further enhance the displaying of packages and products.

Figure 13:
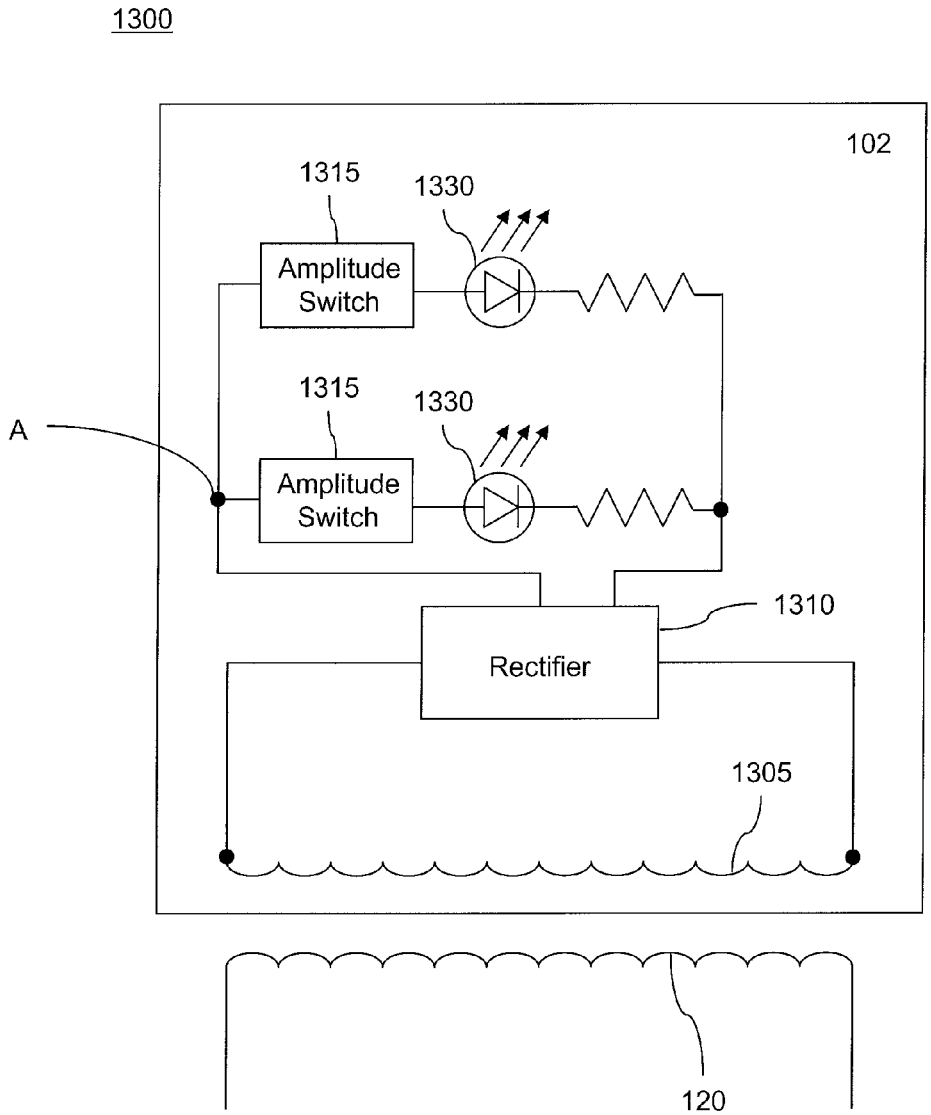
FIG. 13 shows another illustrative circuit for powering at least two light elements on a product or package.

In yet another configuration shown in FIG. 13, circuit 1300 provides power to two different light sources. Circuit 1300 includes a coil 1305 that generates power when mutually inductively coupled to coil 120. The power generated by coil 1305 is rectified by rectifier 1310 to provide a substantially stable DC power output. The DC power output by rectifier 1310 is provided to a first sub-circuit that includes amplitude switch 1315 and LED 1320. DC power is also supplied to a second sub-circuit that includes amplitude switch 1325 and LED 1330.

Operation of circuit 1300 is as follows. A certain amount of current is passed through coil 120 which in turn causes the output of coil 1305 to output DC power at certain amplitude at node A. Amplitude switch 1315 turns on when a certain voltage range is applied to it and turns off when a voltage outside of that range is applied to it. Mathematically, amplitude switch turns on when the voltage at node A ($V_A$) is:

$$V_{LT1} \leqq V_A \leqq V_{UT1}$$

where $V_{LT1}$ is the lower voltage threshold and $V_{UT1}$ is the upper voltage threshold of amplitude switch 1315. If voltage $V_A$ is less than $V_{LT1}$, or above $V_{UT1}$, amplitude switch 1315 turns off and thereby turns off light source 1320.

Amplitude switch 1325 operates differently. It turns on when $V_A$ exceeds a lower threshold or:

$$V_{LT2} \leqq V_A$$

where $V_{LT2}$ is the lower voltage threshold of amplitude switch 1325. The values of $V_{LT1}$, $V_{UT1}$ and $V_{LT2}$ can be adjusted by a dial (not shown) before placing the package or product on a shelf. Typically, however, these values will be set when the package or product is manufactured. In one implementation, values are set such that:

$$V_{UT1} \leqq V_{LT2}$$

This allows for light sources 1320 and 1330 to be turned on and off substantially independently of each other by varying the amplitude of the current passing through coil 120. By passing a certain amount of current through coil 120, the voltage $V_A$ will be between $V_{LT1}$ and $V_{UT1}$ but less than $V_{LT2}$. This causes amplitude switch 1315 to turn on and amplitude switch 1325 to turn off. This in turn causes light source 1320 to turn on and light source 1330 to turn off. By increasing the current through coil 120 the voltage $V_A$ will increase so it is greater than both $V_{UT1}$ and $V_{LT2}$. This causes amplitude switch 1315 to turn off and amplitude switch 1325 to turn on. This in turn causes light source 1320 to turn off and light source 1330 to turn on.

Figure 14:
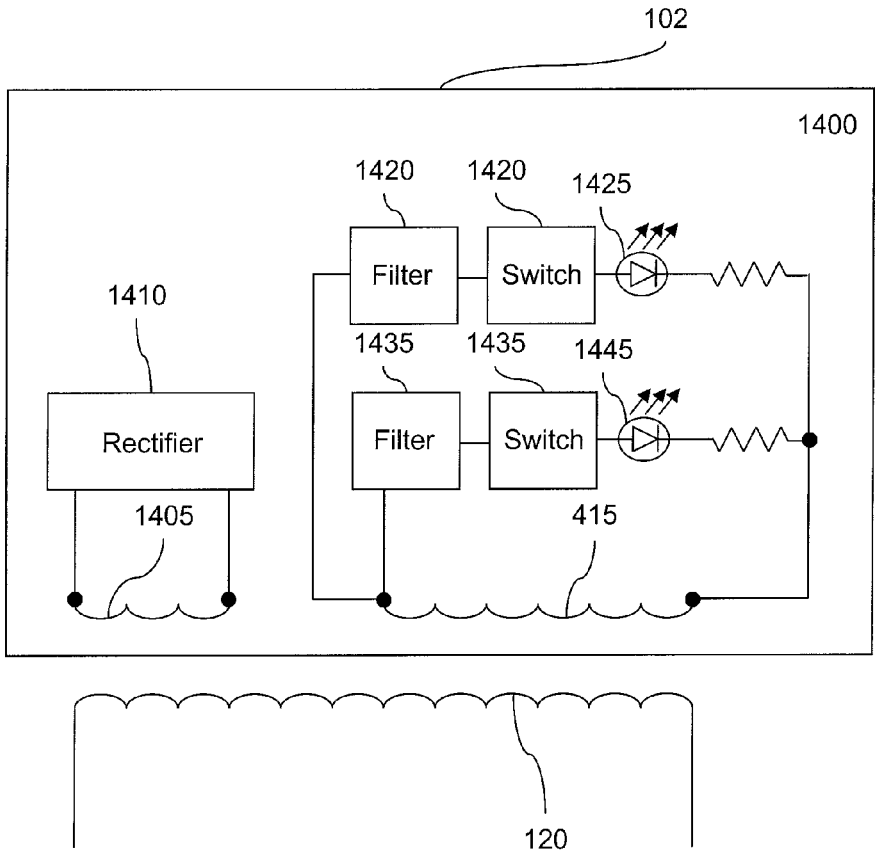
FIG. 14 shows another illustrative circuit for powering at least two light elements on a product or package.

FIG. 14 shows a circuit 1400 that provides power to two different light sources. Circuit 1400 includes coil 1405 that provides power to rectifier 1410. Circuit 1400 also includes a second coil 1415 that is coupled to two sub-circuits. The first sub-circuit circuit includes filter 1420, switch 1425 and light source 1430 (shown as an LED in FIG. 14). The second sub-circuit includes filter 1435, switch 1440 and light source 1445 (also shown as an LED in FIG. 14).

Operation of circuit 1400 is as follows. Coil 1405 and rectifier 1410 produce a substantially stable DC power output as previously described. Coil 1415 produces a signal due to its being mutual inductively coupled to coil 120. The frequency of the signal generated by coil 1415 is substantially similar to the frequency of the current passing through coil 120. Filters 1420 and 1435 are frequency dependent. Examples of filters that may be used include low pass, high pass and band pass. The frequency responses of filters 1420 and 1435, in conjunction with the frequency of the current in coils 1415 and 120, determine how much of the signal generated by coil 1415 is passed to switches 1425 and 1440. This in turn determines whether switches 1425 and 1440 turn on to turn on light sources 1430 and 1445 or turn off to turn off light sources 1430 and 1445.

As an example, assume filter 1420 is a low pass filter that passes signals at 30 Hz and below and assume filter 1435 is a high pass filter that passes signals at 45 Hz and above. If the current passes through coil 120 at a frequency of 20 Hz, coil 1415 will output a signal at 20 Hz. Filter 1420 passes this signal through, which in turn turns on switch 1425 and light source 1430. Filter 1435, however, blocks the signal output from coil 1415, which in turn turns off switch 1440 and light source 1445.

If the frequency of the current through coil 120 is then changed to 60 Hz, coil 1415 will similarly produce a signal at 60 Hz. Filter 1420 blocks the signal from coil 1415 to switch 1425, which turns off switch 1425 and light source 1430. Filter 1435, however, passes the signal from coil 1415 to switch 1440 which, turns on switch 1440 and light source 1445.

In circuit 1400, it is assumed that filters 1420 and 1435 and switches 1425 and 1440, or a subset thereof, contain active elements that require DC power. This DC power is supplied by coil 1405 and rectifier 1410. If filters 1420 and 1435 and switches 1425 and 1440 only contain passive elements then coil 1405 and rectifier 1410 are not needed. It should be noted that one of ordinary skill in the art could combine circuits and features of circuit 400 and circuits 1300 and 1400 to provide even greater flexibility in how to provide a variety of changing displays.

Circuits 1300, 1400 and 600 (when processor 620 senses the output of coil 605) change which light source is illuminated or which image is displayed on screen 505 when the frequency and/or amplitude of the current passing through coil 120 changes. This allows for dynamic advertising to the potential buyers. Suppose it is known that one group (group A) shop at a particular store primarily during one part of the day or week and another group (group B) shop at that same store but primarily at a different time of day or week. Suppose each group also responds differently to differently stimulus. For example, if group A tends to buy more products when a light source is red or a particular image is presented on a screen while group B tends to buy more products when a light source is blue or a different image is presented on the screen. The store owner can adjust the frequency, amplitude or both of the current passing through coil 120 and change the appearance of packages 100 depending on the time of day or week. This in turn will target group A or group B accordingly so as to maximize the amount of products purchased from the store. The same can be done for changing the frequency of a flashing light as was described in conjunction with FIG. 4 to target groups A and B accordingly.

Finally, it should be noted that while the figures show package 100 and product 1200 being in contact with the various shelf systems, this is not a requirement. In one example, package 100 or product 1200 may be placed a relatively small distance from divider 1110 and still operate properly.

The invention claimed is:

1. A device, comprising:

a housing; and a circuit wherein the circuit further comprises:

a display element coupled to the housing;

a first coil coupled to the display element and the housing; and a rectifier circuit coupled between the display element and the first coil;

wherein the circuit further comprises an amplitude switch coupled between the rectifier and the display element;

further comprising a second amplitude switch and a second display element, wherein the second amplitude switch is coupled between the rectifier and the second display element, the first amplitude switch turns off in response to receiving a voltage from the rectifier outside a first range of the voltage, the second amplitude switch turns off in response to receiving the voltage outside a second range of the voltage, and the first and second ranges are different from one another.

2. The device of claim 1 wherein the circuit further comprises:

a frequency divider coupled between the display element and the first coil.

3. The device of claim 2 wherein the circuit further comprises:

a second coil coupled to the housing; and a rectifier circuit coupled between the second coil and the frequency divider.

4. The device of claim 1 wherein the display element is an LED.

5. The device of claim 1 wherein the display element is a screen.

6. The device of claim 5 wherein the circuit further comprises a processor coupled to the rectifier circuit.

7. The device of claim 1 wherein the circuit includes a sub-circuit that provides power via a battery.

8. The device of claim 1 wherein the circuit includes a sub-circuit that provides power via a connection to an outlet.

9. The device of claim 1 wherein the circuit further comprises a first filter coupled between the first coil and the display element.

10. The device of claim 9, further comprising a second filter, wherein the second filter is coupled between the first coil and the second display element, the first filter passes signals within the first range, the second filter passes signals within the second range, and the second filter blocks at least some frequency components within the first range.

11. The device of claim 9 wherein the circuit further comprises a switch coupled between the first filter and the display element.

12. The device of claim 1, wherein the display element and the first coil are arranged within the housing.

13. The device of claim 1, wherein the display element is arranged on the housing.

* * * * *